US005425143A

United States Patent [19]

Kalandovsky

[11] Patent Number: 5,425,143

[45] Date of Patent: Jun. 20, 1995

[54] MULTIPLE POOL COVER DEPLOYMENT METHOD AND APPARATUS

[76] Inventor: Jiri Kalandovsky, 7482 Crannell Dr., Boulder, Colo. 80303

[21] Appl. No.: 278,429

[22] Filed: Jul. 21, 1994

[51] Int. Cl.[6] ..... E04H 4/10

[52] U.S. Cl. ..... 4/502; 4/498; 242/388.6; 242/403; 242/564.2; 242/919

[58] Field of Search ..... 4/498, 500, 502; 242/388.6, 388.7, 395, 403, 403.1, 406, 557, 562.1, 564.2, 919

[56] References Cited

U.S. PATENT DOCUMENTS

| | | | |
|---|---|---|---|
| 4,103,368 | 8/1973 | Lockshaw . | |
| 4,313,421 | 2/1982 | Trihey | 126/415 |
| 4,324,370 | 4/1982 | Guard et al. | 4/502 X |
| 4,328,930 | 5/1982 | Kalendovsky | 4/498 X |
| 4,385,407 | 5/1983 | Zook | 4/499 |
| 4,402,305 | 9/1983 | Kremen | 126/415 |
| 4,407,027 | 10/1983 | Colon, Jr. | 4/502 |
| 4,411,031 | 10/1983 | Stolar | 4/502 |
| 4,459,711 | 7/1984 | Sartain et al. | 4/502 |
| 4,467,978 | 8/1984 | Farrington | 4/502 X |
| 4,470,404 | 9/1984 | Kremen | 126/415 |
| 4,709,688 | 12/1987 | Paradis | 126/415 |
| 4,972,529 | 11/1990 | Wolfson, jr. | 4/500 |
| 5,184,356 | 2/1993 | Löf et al. | 4/502 |

*Primary Examiner*—Robert M. Fetsuga
*Attorney, Agent, or Firm*—John R. Flanagan

[57] ABSTRACT

A multiple pool cover deployment apparatus includes a portable carriage having a movable frame placed at one end of a pool and a main storage reel rotatably mounted thereon and having pool covers successively wound about the main reel. The apparatus also includes a first storage spool rotatably mounted to the frame adjacent to the main storage reel. The first storage spool has an elongated flexible rope wound thereabout. The apparatus also includes a portable stand placed at an opposite end of the pool across from the portable carriage and a second storage spool rotatably mounted on the portable stand. The rope is interconnected by a connector to a leading end of the outer pool cover and a leading portion of the rope is stretched across the pool and connected to the second storage spool for winding thereabout by rotating the second storage spool to cause unwinding of the outer pool cover from the main storage reel and unwinding of the rope from the first storage spool and concurrent pulling of the outer one of the pool covers and the rope across the pool from the portable carriage to the portable stand. The apparatus further includes an auxiliary storage reel mounted to the frame with a protective cover which can be attached to the last pool cover and wound over the multiple pool covers to provide protection against sun radiation.

20 Claims, 2 Drawing Sheets

MULTIPLE POOL COVER DEPLOYMENT METHOD AND APPARATUS

BACKGROUND OF THE INVENTION

1. Field of the Invention

The present invention generally relates to pool cover systems and, more particularly, is concerned with multiple pool cover deployment method and apparatus.

2. Description of the Prior Art

Commercial swimming pools are expensive to operate mainly because of the enormous consumption of energy to maintain them at the desired temperature. In this respect indoor pools are even more expensive because they operate year round. To keep a comfortable relative humidity in a natatorium requires a complex exhaust system in which cold air is taken in and warm moisture-laden air is exhausted out. Even natatoriums with dehumidifying equipment which recovers energy, costs almost as much to operate as externally exhausting ones.

To conserve energy some pool owners have been using thermal or solar covers which retain heat and reduce water evaporation during the pool's idle periods and thus reduce energy consumption. Examples of pool cover systems found in the prior patent art are disclosed in U.S. Pat. Nos. to Lockshaw (4,103,368), Trihey (4,313,421), Zook (4,385,407), Kremen (4,402,305 and 4,470,404), Stolar (4,411,031), Sartain et al (4,459,711), Paradis (4,709,688), Wolfson et al (4,972,529) and Lof et al (5,184,356).

One problem associated with pool cover systems is that the deployment or retraction of pool covers from the pool surface is difficult. As exemplified by several of these patents, in order to handle pool covers more conveniently a variety of reel systems have been developed for residential and commercial application. With manually operated reel systems, however, the covering and uncovering of a pool is cumbersome and time-consuming, especially with installations at large commercial pools employing multiple covers. To wind up all the covers usually more than one reel is deployed or, more often, a reel with two or three cylinders on one carriage is needed. When the cover has to be deployed, a reel is positioned adjacent to the edge of the pool so that a cover can be unwound therefrom and laid across the pool surface as desired. The covers are usually unwound by being pulled by hand. In more advanced systems the covers are deployed with a rope which is attached to a leading edge of the cover, then stretched across the pool length and pulled from the opposite end by hand. After the cover has been laid down, the operator has to detach the rope and take the rope back to the reel at the opposite side of the pool. The operator must then attach the rope to the next cover, walk back to the opposite end of the pool and repeat these operations as many times as there are covers.

Another problem associated with pool cover systems is that for outdoor pools, the covers when wound on the reel have to be protected from the sun (especially the translucent polyethylene bubble type commonly referred to as solar covers). First of all, heat eventually causes it to delaminate or even melt down. Second, the ultra violet radiation gradually alters the molecular structure of the material causing it to become brittle and start to disintegrate prematurely. To prevent this from happening, the manufacturers of these products supply each cover with a white plastic sheet and instructions on how to use it. However, the prescribed procedures are rather cumbersome, and for that reason, the protective covers frequently are not applied properly or not used at all. As a result, the covers do not last as long as they would with proper care.

In view of the above-described problems, a need exists for improvement of the current pool cover systems particularly in the case of systems using multiple pool covers.

SUMMARY OF THE INVENTION

The present invention provides a multiple pool cover deployment method and apparatus designed to satisfy the aforementioned need. The deloying method and apparatus of the present invention provides a relatively easy way to deploy pool covers on the pool surface by reducing much of work in handling the rope to stretch each pool cover across the length of the pool by eliminating the need to carry the rope back and forth between the opposite ends of the pool. Heretofore, the operator had to detach the rope from a just deployed pool cover and then take the rope back to the reel at the starting end of the pool. Upon reaching the starting end, the operator had to then reattach the rope to the next pool cover, walk back to the finishing end of the pool and repeat these operations as many times as there are covers. By using a continuous rope whose overall length matches that of the multiple pool covers, trips back and forth between the opposite starting and finishing ends of the pool are made by the operator but without carrying or dragging the rope. The deploying method and apparatus also overcomes the problem of protecting the wound up pool covers from the sun by providing an auxiliary reel on the portable stand which holds a roll of protective cover and is readily adapted to be unreeled and extending over the wound pool covers.

Accordingly, the present invention is directed to a multiple pool cover deployment apparatus which comprises: (a) a portable carriage having a movable frame for placement at one end of a pool and a main storage member rotatably mounted on the movable frame with a plurality of pool covers successively wound about the main storage member and capable of being successively unwound therefrom by pulling on an outer one of the covers; (b) a first storage member rotatably mounted to the movable frame adjacent to the main storage member, the first storage member having an elongated flexible rope wound thereabout and capable of being unwound therefrom by pulling on the rope; (c) means for interconnecting a portion of the rope to a leading end of an outer one of the pool covers successively wound on the main storage member; (d) a portable stand for placement at an opposite end of the pool across from the portable carriage; and (e) a second storage member rotatably mounted on the portable stand, the second storage member having a leading portion of the rope connected thereto for winding about the second storage member upon rotation thereof to cause pulling of a first section of the rope and outer one of the pool covers concurrently across the pool from the portable carriage to the portable stand and thereby unwinding of the outer pool cover from the main storage member and of the rope from the first storage member.

The apparatus also comprises an auxiliary storage reel mounted to the frame with a protective cover which, after the pool covers are rewound back onto the main storage reel, can be attached to the last pool cover and wound over the multiple pool covers to provide protection against sun radiation. The protective cover can be retracted therefrom and rewound about the auxiliary storage reel when the cover are re-deployed.

The present invention is also directed to a multiple pool cover deployment method which comprises the steps of: (a) providing a portable carriage in a first lateral position along one end of a pool with a rotatable main storage reel and a plurality of pool covers successively wound thereabout; (b) providing a first storage spool rotatably mounted to the portable carriage and having an elongated flexible rope wound thereabout; (c) interconnecting a portion of the rope to a leading end of an outer one of the pool covers wound on the main storage reel; (d) providing a portable stand at an opposite end of the pool across from the portable carriage; (e) providing a second storage spool rotatably mounted on the portable stand and having a leading portion of the rope connected thereto for winding about the second storage spool upon rotation thereof to cause pulling of a first section of the rope and the outer one of the pool covers concurrently across the pool from the portable carriage to the portable stand and thereby unwinding of the outer pool cover from the main storage reel and of the rope from the first storage spool and stretching of the outer pool cover across the pool between the opposite ends thereof aligned with the first lateral position.

The deployment method further comprises the steps of, upon completing unwinding and deploying of the outer pool cover and rope across the pool, moving the portable carriage to the next lateral position along the one end of the pool and attaching the next outer pool cover to another portion of the rope extending from the first storage spool so that by again rotating the second storage spool, the next pool cover and a successive section of rope are pulled across the pool. Thereafter, the previous steps are repeated until the pool is completely covered by the plurality of pool covers in substantially side-by-side relationship to one another. Finally, the deployment method includes the step of interchanging the full second storage spool with the rope being wound thereabout for the empty first storage spool so as to eliminate the need to rewind the rope from the second storage spool back onto the first storage spool.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
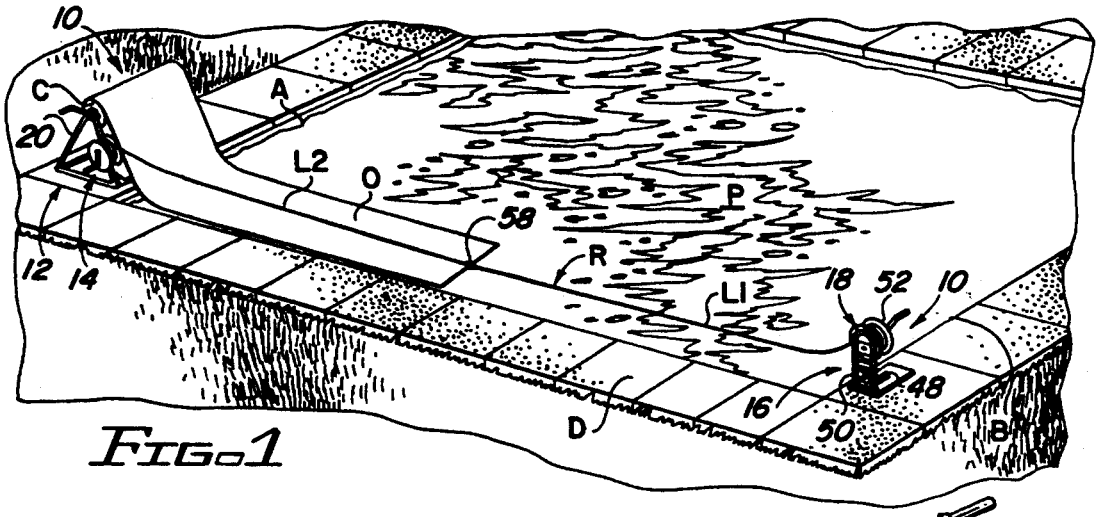
FIG. 1 is a perspective view of the multiple pool cover deployment apparatus of the present invention having a portable carriage, a first rope storage member mounted to a lateral end of the portable carriage, and a portable stand mounting a second rope storage member, showing the apparatus in use to carry out the steps of the deployment method of the present invention.

Referring to the drawings and particularly to FIG. 1, there is illustrated a multiple pool cover deployment apparatus of the present invention, being generally designated 10, shown positioned on a deck D encompassing a swimming pool P. Basically, the multiple pool cover deployment apparatus 10 includes a portable mobile carriage 12 placed at one end A of the pool P, a first rope storage member 14 disposed adjacent to the portable carriage 12, a portable movable stand 16 placed at an opposite end B of the pool P across from the portable carriage 12 at the one end A thereof, and a second rope storage member 18 rotatably mounted on the portable stand 16.

Figure 2:
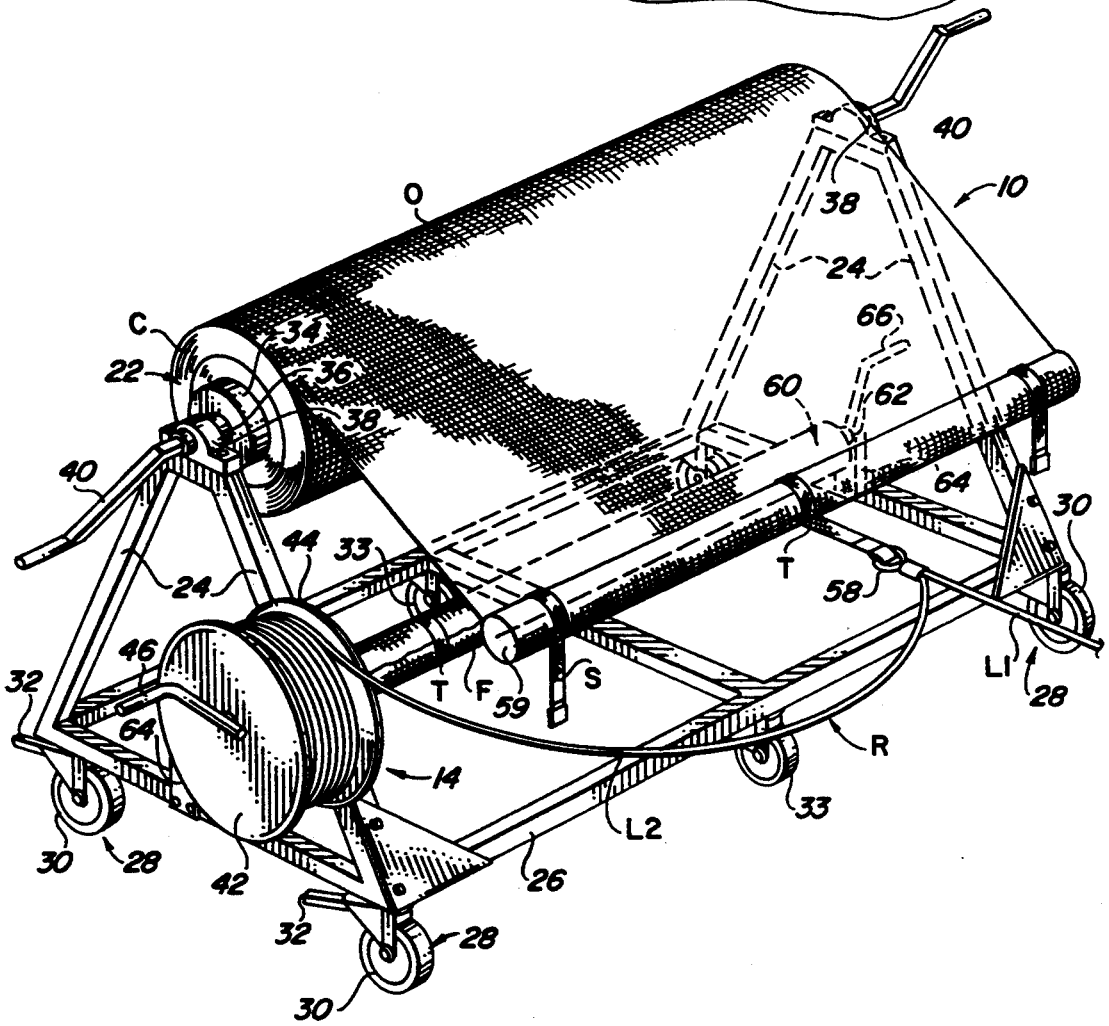
FIG. 2 is an enlarged perspective view of the portable carriage and first storage member mounted to the carriage, showing the components of the portable carriage in position to unwind and deploy multiple covers therefrom.
Figure 3:
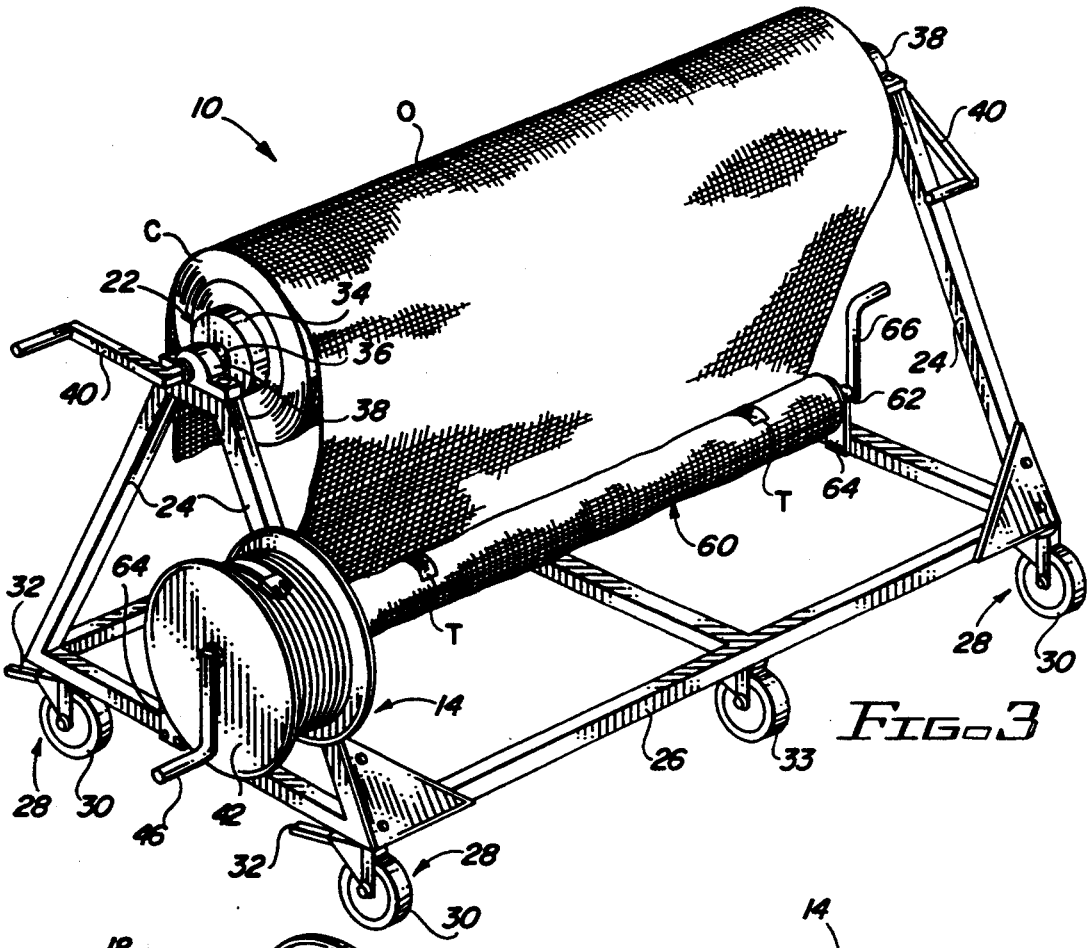
FIG. 3 is a perspective view similar to that of FIG. 2, but showing the components of the portable carriage after the multiple covers have been rewound and in position to wind a protective cover over the wound roll of multiple covers.
Figure 4:
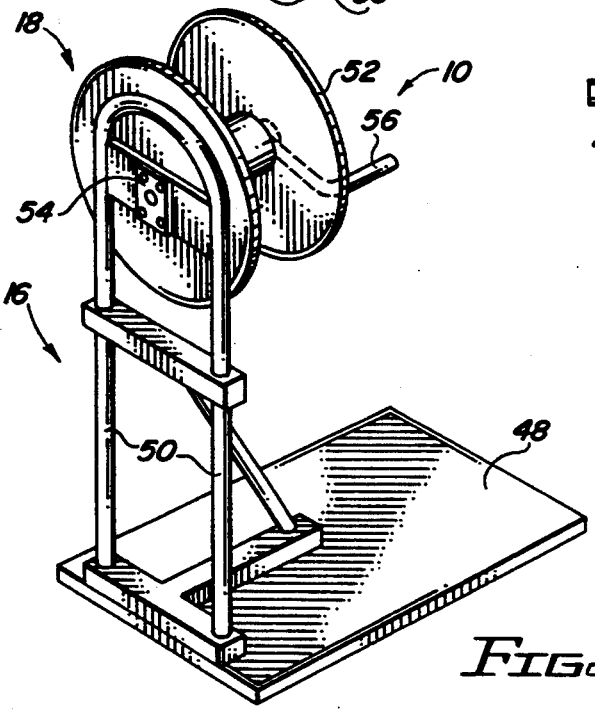
FIG. 4 is a perspective view of the portable stand with the second rope storage member mounted thereto.

Referring to FIGS. 1 to 3, the portable mobile carriage 12 of the multiple pool cover deployment apparatus 10 includes a movable frame 20 and a main multiple pool cover storage member 22 rotatably mounted on the portable frame 20. The movable frame 20 includes a pair of generally vertical end frame portions 24 of trapezoidal shape and a generally horizontal base frame portion 26 of rectangular shape extending between and rigidly interconnecting lower ends of the vertical end frame portions 24. The portable carriage 12 is made mobile by a plurality of rotatable ground-engaging wheel assemblies 28 underlying and attached at the corners of the base frame portion 26 and movably supporting the frame 20 thereabove. The wheel assemblies 28 preferably include caster wheels 30 and swivel lock and brake mechanisms 32 respectively facilitating movement of the portable carriage 12 along a straight path across the deck D of the swimming pool P and securing of the portable carriage 12 at a stationary or immovable position when desired. The swivel lock and brake mechanisms 32 are in the form of pedals which function in a conventionally known matter. The pedals 32 are depresssed to activate braking action and lifted and released to deactivate the braking action. Two more caster wheels 33 are mounted under the center of the horizontal base frame portion 26 of the movable frame 24 as additional support for the mobile carriage 12.

The main storage member 22 of the portable carriage 12 includes a main cylindrical reel 34 and axles 36 extending from opposite ends thereof. The axles 36 are rotatably mounted by respective bearings 38 fixed upon upper ends of the opposite vertical end frame portions 24 of the movable frame 20, The main storage member 22 also includes means for rotating the main reel 34, such as a pair of main cranks 40 removably attached to the respective axles 36 at the opposite ends of the main cylindrical reel 34. Either one of the main cranks 40 is adapted to be gripped and turned by an operator to manually rotate the main reel 34. The main cranks 40 can be removed from the respective axles 36 and replaced in reverse such that they overlap with the vertical frame end portions and will prevent rotation of the main reel 34. As an alternative, instead of the main cranks 40, a rotary power source, such as an electric motor (not shown), can be provided to rotate the main reel 34. The main reel 34 has a plurality of pool covers C successively wound thereabout and capable of being successively unwound therefrom by pulling on the outer one O of the covers C.

Figure 5:
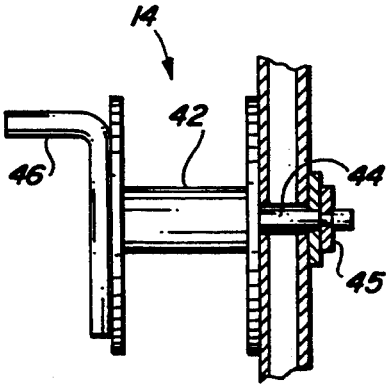
FIG. 5 is an end elevational view of a first rope storage member of the apparatus.

Referring to FIGS. 1, 3 and 5, the first rope storage member 14 of the multiple pool cover deployment apparatus 10 includes a first cylindrical spool 42 rotatably and removably mounted to one of the vertical end frame portions 24 of the frame 20 in any suitable manner, such as by a shaft 44 (FIG. 5) fixed to and extending horizontally outwardly from an inner side of the spool 42. A clip 45 removably interfits across an end of the shaft 44 to retain the shaft 44 through the frame 20 but to allow removal of the spool 42 upon removal of the clip 45. The first rope storage member 14 also includes a first handle 46 attached to an outer side. The first handle 46 of the first rope storage member 14 provides means for rotating the first spool 42. The first storage spool 44 has an elongated flexible rope R wound thereabout and capable of being unwound therefrom by pulling on the rope R. The rope R has a length at least equal and preferably greater than to the combined lengths of the pool covers successively wound about the main reel 34. The first handle 46 is adapted to be used by an operator to manually rotate the first spool 44.

The portable stand 16 of the multiple pool cover deployment apparatus 10 includes a flat base plate 48 and an inverted-U shaped upright brace 50 mounted and extending in an upstanding position on one edge portion of the flat base member 48. The second rope storage member 18 of the multiple pool cover deployment apparatus 10, having substantially the same construction as the first rope storage member 14, includes a second cylindrical spool 52 having a shaft (not shown) rotatably and removably mounted by a bracket 54 to an upper end of the upright brace 50 of the portable stand 16. The second storage member 18 also includes a second handle 56 attached to the second spool 52 and adapted for use by an operator in manually rotating the second spool 52. The second storage member 18 thus serves as a winch for applying a pulling force to the outer pool cover O. The first and second spools 42, 52 can be removed from their respective locations and interchanged in order to avoid the need to rewind the rope from one to the other thereof. The flat base plate 48 of the portable stand 16 can be provided with caster wheels (not shown) along one edge for facilitating repositioning of the stand. The flat base member 48 is designed for the operator to place a foot on the plate 48 to hold it stationary and secure its stability during use.

The rope R is preferably an uninterrupted piece with a plurality of connectors 58 (only one of which being seen in FIG. 2) suitably mounted thereto at spaced intervals to define a series of sections or lengths extending between the connectors 58. Each connector 58 is adapted to interconnect the rope R to an elongated lightweight tube 59 inserted through a leading end of each of the pool covers C after having advanced to the outer position on the main reel 34 in preparation for being pulled across the pool P. A given section L1 of the rope R is stretched across the pool P and connected to the second spool 52 for winding thereabout by rotating the second handle 56 on the second spool 52. Such winding of the rope R about the second spool 52 causes pulling of the one outer pool cover O and the section L1 of the rope R across the pool P from the portable carriage 12 to the portable stand 16 and thereby concurrent unwinding of the outer pool cover O from the main reel 34 and unwinding of the next succeeding section L2 of the rope R from the first spool 42. The lightweight tube 59 ensures even distribution of the pulling force across the pool cover width and also increases the buoyancy of the leading end of the pool cover C so as to prevent it from diving under the water during deployment.

The multiple pool cover deployment apparatus 10 also includes an auxiliary storage member 60 rotatably mounted on the movable frame 20. The auxiliary storage member 60 includes an auxiliary cylindrical reel 62 rotatably mounted at its opposite ends to respective bearings 64 which are mounted upon the horizontal base frame portions 26 of the movable frame 20 and below the bearings 38 rotatably mounting the main reel 34 directly above the auxiliary reel 62. The auxiliary storage member 60 also includes means for rotating the auxiliary reel 62, such as an auxiliary crank 66 attached to one end of the auxiliary reel 62 and being adapted for gripping and turning by an operator to manually rotate the auxiliary reel 62. The auxiliary reel 62 is smaller in diameter than the main reel 34 in view that the auxiliary reel 62 is only provided to support and store in a wound-up condition a protective cover F for use in covering the multiple pool covers C wound and stored about the main reel 34. Once the pool covers C are wound over the main reel 34, the protective cover F is connected to the last one of the pool covers C using connectors T and S and, using the crank 40, the protective cover F is reeled over the pool covers wound on the main reel 34 to form a protective envelope thereover. In a reverse action, when the protective cover F has to be removed to deploy the pool covers C, the auxiliary crank 66 is employed to rotate the auxiliary reel 62 and wind the protective cover F back on the reel 62. In order to prevent free rotation of the reel 62 and thereby prevent cover F from falling to the ground, friction bearings rotatably mount opposite ends of the reel 62 to the frame 20 so that rotation of the auxiliary reel 62 is impeded absent any positive movement of the auxiliary crank 66.

The above-described multiple pool cover deployment apparatus 10 is used to deploy the multiple pool covers C across the pool P and in side-by-side relationships to one another so as to cover the entire surface of the pool. Such deployment begins by placing the portable carriage 12 in a first lateral position, as seen in FIG. 1, on the deck D along one end A of the pool P with the plurality of pool covers C being successively wound thereabout. Also, portable carriage 12 is setup with the first rope storage spool 42 rotatably mounted to the one end of the movable frame 20 of the carriage 12 and with the elongated flexible rope R wound thereabout. Also, the portable stand 16 is placed on the deck D at the opposite end B of the pool P across from the portable carriage 12. First and second sections L1, L2 of the rope R, as well as subsequent sections, are preferably portions of a single uninterrupted rope on which connectors 58 are mounted at appropriate distances therebetween which can be connected to the leading edge of the outer one O of the pool covers C wound on the main reel 34. The leading end of the first section L1 of the rope R is connected to the second spool 52 rotatably mounted to the portable stand 16. By using the second handle 56, the second spool 52 on the portable stand 16 is rotated so as to cause pulling of the first section L1 of the rope R and the outer one O of the pool covers C across the pool P from the portable carriage 12 to the portable stand 16. Concurrently, the outer pool cover O unwinds from the main storage reel 34 and the second section L2 of the rope R unwinds from the first spool 42 until the outer pool cover O and second rope section L2 are fully stretched across the pool P between the opposite ends A,B thereof and aligned with the first lateral position of the portable carriage 12 shown in FIG. 1.

Upon such completion of unwinding and deploying of the outer pool cover O and rope R across the pool P, the portable carriage 12 is then moved to the right in FIG. 1 to the next lateral position along the one end A of the pool P. A succeeding connector 58 on the rope R is then connected to the next outer pool cover C so that by again rotating the second spool 52, the next one of the pool covers C and a successive section of the rope R are pulled across the pool P. Thereafter, these same steps are repeated until the pool is completely covered by the plurality of pool covers in substantially side-by-side relationship to one another. After completion of deployment of the pool covers, the second spool 52 now containing most of the rope wound about it and the first spool 42 which is now substantially empty, are removed from their respective locations and interchanged with one another which eliminates the need to rewind the rope R from the second spool 52 back onto the first spool 42.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. A multiple pool cover deployment apparatus, comprising:

(a) a portable carriage having a movable frame for placement at one end of a pool and a main storage member rotatably mounted on said movable frame with a plurality of pool covers successively wound about said main storage member and capable of being successively unwound therefrom by pulling on an outer one of said covers;

(b) a first rotatable storage member disposed adjacent to said main storage member on said movable frame, said first storage member having an elongated flexible rope wound thereabout and capable of being unwound therefrom by pulling on the rope;

(c) means for interconnecting a portion of said rope to a leading end of an outer one of said pool covers successively wound on said main storage member;

(d) a portable stand for placement at an opposite end of the pool across from said portable carriage; and (e) a second storage member rotatably mounted on said portable stand, said second storage member having a leading portion of the rope connected thereto for winding about said second storage member upon rotation thereof to cause pulling of the rope and outer one of the pool covers concurrently across the pool from said portable carriage to said portable stand and thereby unwinding of the outer pool cover from said main storage member and of the rope from said first storage member.

2. The apparatus of claim 1 wherein said interconnecting means is a connector.

3. The apparatus of claim 1 wherein said main storage member includes:

a main reel rotatably mounted at opposite ends to opposite ends of said movable frame; and a main crank attached to an end of said main reel and being adapted for use in manually rotating said main reel.

4. The apparatus of claim 3 further comprising:

an auxiliary storage member rotatably mounted on said movable frame with a protective cover wound about said auxiliary storage member and capable of being connected to a last pool cover and unwound from said auxiliary storage member over the plurality of wound covers on said main reel.

5. The apparatus of claim 4 wherein said auxiliary storage member includes:

an auxiliary reel rotatably mounted at opposite ends to opposite ends of said movable frame; and an auxiliary crank attached to said auxiliary reel and being adapted for use in manually rotating said auxiliary reel.

6. The apparatus of claim 5 wherein said auxiliary reel is rotatably mounted on said movable frame spaced below said main reel.

7. The apparatus of claim 1 wherein said first storage member includes:

a first spool rotatably mounted to said movable frame adjacent to said main storage member; and a first handle attached to said first spool and being adapted for use in manually rotating said first spool.

8. The apparatus of claim 7 wherein said second storage member includes:

a second spool rotatably mounted to said portable stand; and a second handle attached to said second spool and being adapted for use in manually rotating said second spool.

9. The apparatus of claim 1 further comprising:

an auxiliary storage member rotatably mounted on said movable frame with a protective cover wound about said auxiliary storage member and capable of being connected to a last pool cover wound on said main storage member and unwound from said auxiliary storage member over the plurality of wound covers on said main storage member.

10. The apparatus of claim 9 wherein said auxiliary storage member includes:

an auxiliary reel rotatably mounted at opposite ends to opposite ends of said movable frame; and an auxiliary crank attached to said auxiliary reel and being adapted for use in manually rotating said auxiliary reel.

11. The apparatus of claim 10 wherein said auxiliary reel is rotatably mounted on said movable frame spaced below said main storage member.

12. The apparatus of claim 1 wherein said second storage member includes:

a second spool rotatably mounted to said portable stand; and a second handle attached to said second spool and being adapted for use in manually rotating said second spool.

13. The apparatus of claim 1 wherein said movable frame includes a pair of generally vertical end frame portions and a generally horizontal base frame portion extending between and rigidly interconnecting lower ends of said vertical end frame portions.

14. The apparatus of claim 1 wherein said portable stand includes:

a flat base plate; and an upright brace mounted in an upstanding position on one edge portion of said flat base member.

15. The apparatus of claim 14 wherein said second storage member is a second spool removably mounted to an upper portion of said upright brace of said portable stand.

16. A multiple pool cover deployment method, comprising the steps of:

(a) providing a portable carriage in a first lateral position along one end of a pool with a rotatable main storage reel rotatably mounted thereon and a plurality of pool covers successively wound about the main storage reel;

(b) providing a first storage spool rotatably mounted to the portable carriage and having an elongated flexible rope wound thereabout;

(c) interconnecting a portion of the rope to a leading end of an outer one of the pool covers wound on the main storage reel;

(d) providing a portable stand at an opposite end of the pool across from said portable carriage;

(e) providing a second storage spool rotatably mounted on said portable stand and having a leading portion of the rope connected thereto for winding about said second storage spool upon rotation thereof to cause pulling of a first section of said rope and said outer one of the pool covers concurrently across the pool from said portable carriage to said portable stand and thereby unwinding of the outer pool cover from said main storage reel and of said rope from said first storage spool and thereby stretching of said outer pool cover across the pool between the opposite ends thereof aligned with the first lateral position.

17. The method of claim 16 further comprising the step of:

upon completing unwinding and deploying of the outer pool cover and rope across the pool, moving the portable carriage to the next lateral position along the one end of the pool and attaching the next outer pool cover to another portion of the rope extending from the first storage spool so that by again rotating the second storage spool, the next pool cover and a second section of rope can be pulled across the pool.

18. The method of claim 17 further comprising the step of:

thereafter, repeating the previous steps until the pool is completely covered by the plurality of pool covers disposed in substantially side-by-side relationship to one another.

19. The method of claim 18 further comprising the step of:

interchanging the full second storage spool with the rope being wound thereabout for the empty first storage spool so as to eliminate the need to rewind the rope from the second storage spool back onto the first storage spool.

20. The method of claim 16 further comprising the step of:

providing an auxiliary storage reel rotatably mounted on the portable carriage and a protective cover wound about the auxiliary storage reel and capable of connected to the last pool cover on the main storage reel unwound from the auxiliary storage reel over the roll of multiple covers wound on the main storage reel.

* * * * *